US005629717A

United States Patent [19]

Netsu

[11] Patent Number: 5,629,717

[45] Date of Patent: May 13, 1997

[54] DISPLAY SYSTEM

[75] Inventor: Hiroshi Netsu, Funabashi, Japan

[73] Assignee: Canon Kabushiki Kaisha, Tokyo, Japan

[21] Appl. No.: 432,007

[22] Filed: May 1, 1995

Related U.S. Application Data

[63] Continuation of Ser. No. 144,498, Nov. 2, 1993, abandoned, which is a continuation of Ser. No. 797,359, Nov. 25, 1991, abandoned, which is a division of Ser. No. 426,766, Oct. 26, 1989, abandoned.

[30] Foreign Application Priority Data

| | | | |
|---|---|---|---|
| Oct. 31, 1988 | [JP] | Japan | 63-273179 |
| Oct. 31, 1988 | [JP] | Japan | 63-273180 |
| Oct. 31, 1988 | [JP] | Japan | 63-273181 |
| Oct. 31, 1988 | [JP] | Japan | 63-273182 |

[51] Int. Cl.[6] ..... G09G 3/36

[52] U.S. Cl. ..... 345/98; 345/97

[58] Field of Search ..... 358/313, 213.18, 358/136, 190; 455/171.1; 345/55, 87, 92, 98, 97

[56] References Cited

U.S. PATENT DOCUMENTS

| | | | |
|---|---|---|---|
| 4,331,977 | 5/1982 | Cohn et al. | 358/190 X |
| 4,367,924 | 1/1983 | Clark et al. . | |
| 4,639,089 | 1/1987 | Okada et al. | 350/341 |
| 4,655,561 | 4/1987 | Kanbe et al. | 350/350 S |
| 4,691,200 | 9/1987 | Stephany | 340/784 |
| 4,693,563 | 9/1987 | Harada et al. | 350/350 S |
| 4,697,887 | 10/1987 | Okada et al. | 350/350 S |
| 4,712,873 | 12/1987 | Kanbe et al. | 350/337 |
| 4,718,112 | 1/1988 | Shinoda | 455/171.1 X |
| 5,264,839 | 11/1993 | Kanno et al. | 345/98 |

FOREIGN PATENT DOCUMENTS

| | | |
|---|---|---|
| 237742 | 9/1987 | European Pat. Off. . |
| 261791 | 3/1988 | European Pat. Off. . |
| 58-053268 | 3/1983 | Japan . |
| 61-059265 | 3/1986 | Japan . |
| 61-272724 | 12/1986 | Japan . |

OTHER PUBLICATIONS

News of the Month, "Wireless World", Jan. 1969, p. 11.

Kaneko et al, "Digital Transmission of Broadcast Television with reduced Bit Rate", Nippon Electric Co., Kawasaki, Japan, NTC, Dec. 1977, 6 pages.

*Primary Examiner*—Ulysses Weldon

*Attorney, Agent, or Firm*—Fitzpatrick, Cella, Harper & Scinto

[57] ABSTRACT

A display system includes a display panel having matrix electrodes with scanning lines and information lines, a display information storage memory for storing display information, and a controller for comparing the information read out from the display information storage memory with write display information to be written in the display information storage memory. The controller stores address information for designating a scanning line corresponding to write display information different from the readout information, scans the scanning line corresponding to the stored address information for a predetermined period of time and controls the matrix electrodes such that only a scanning line corresponding to the stored address information is interrupted after a lapse of the predetermined time period.

8 Claims, 10 Drawing Sheets n : THE NUMBER OF FLAGS m : SET VALUE

DISPLAY SYSTEM

This application is a continuation of application Ser. No. 08/144,498, filed Nov. 2, 1993, which is a continuation of application Ser. No. 07/797,359, filed Nov. 25, 1991, which is a division of application Ser. No. 07/426,766, filed Oct. 26, 1989, now all abandoned.

BACKGROUND OF THE INVENTION

1. Field of the Invention

The present invention relates to a display system which realizes an intrawindow smooth scroll display and a cursor/mouse display on a ferroelectric liquid crystal display panel.

2. Related Background Art

A multiplexing driving scheme for a ferroelectric liquid crystal display panel is disclosed in, e.g., U.S. Pat. No. 4,655,561 to Kanbe. According to this driving scheme, a pulse of one or the other polarity having a peak value and a pulse width enough to satisfactorily cause one or the other of bistable aligning states must be applied at the time of selecting one scanning line. For example, if a selection interval of one scanning line is 150 μsec, one vertical scanning interval (one frame scanning time) for 400 scanning lines is 60 msec, and a frame frequency is 16.7. When the number of scanning lines is increased, the frame frequency is decreased.

For this reason, when a shift display of a cursor or mouse is applied to a ferroelectric liquid crystal display panel, an updating (rewrite) time of one frame is required to be 60 msec for 400 scanning lines. The shift of the cursor or mouse cannot be smoothly displayed. In this manner, an increase in the number scanning lines results in difficulty in a shift display using the cursor or mouse on the ferroelectric liquid crystal display panel.

SUMMARY OF THE INVENTION

It is an object of the present invention to provide a display system capable of performing a smooth shift display of a cursor or mouse on a ferroelectric liquid crystal display panel.

It is another object of the present invention to provide a display system capable of smoothly performing an intrawindow scroll display on a ferroelectric liquid crystal panel.

The present invention is characterized by providing a display system comprising:

a. a display panel having matrix electrodes constituted by scanning lines and information lines;

b. a display information storage memory for storing the display information transferred from a drawer; and c. control means for comparing the information read out from the display information storage memory with write display information to be written in the memory, storing address information for designating a scanning line corresponding to write display information different from the readout information, and controlling the matrix electrodes such that only a scanning line corresponding to the stored address information is scanned.

DETAILED DESCRIPTION OF THE PREFERRED EMBODIMENTS

According to the present invention, a smooth shift display of a cursor or mouse can be achieved by a partial updating/scanning scheme for updating and scanning only scanning lines corresponding to a cursor or mouse display portion to be updated.

Preferred embodiments of the present invention will be described in detail below.

Figure 1:
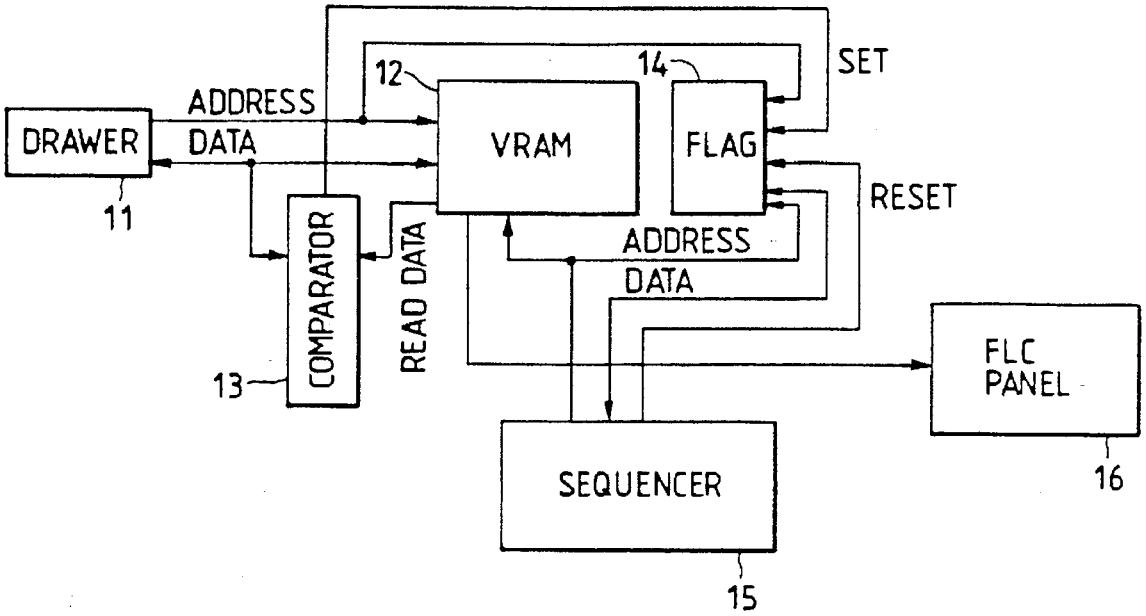
FIG. 1 is a block diagram showing a display system according to an embodiment of the present invention.

FIG. 1 is a block diagram showing a ferroelectric liquid crystal panel control apparatus according to an embodiment of the present invention and its peripheral circuit arrangement. Referring to FIG. 1, the ferroelectric liquid crystal control apparatus includes a drawer 11 such as a CPU, a display information storage memory (VRAM) 12 which can be freely accessed by the drawer 11, a comparator 13 for comparing the data written in the VRAM 12 with the data read out therefrom, and flags 14 which are selectively set when the drawer 11 writes data in the VRAM 12. The number of flags corresponds to the number of display lines on the FLC (ferroelectric liquid crystal) panel. When data is written at an address corresponding to a given display line in the VRAM 12, the flag corresponding to the given line indicates that the updating has been completed. The ferroelectric liquid crystal control apparatus also includes a sequencer 15 for generating a display address or checking and resetting the flags 14, and an FLC panel 16 for performing a display.

Figure 11:
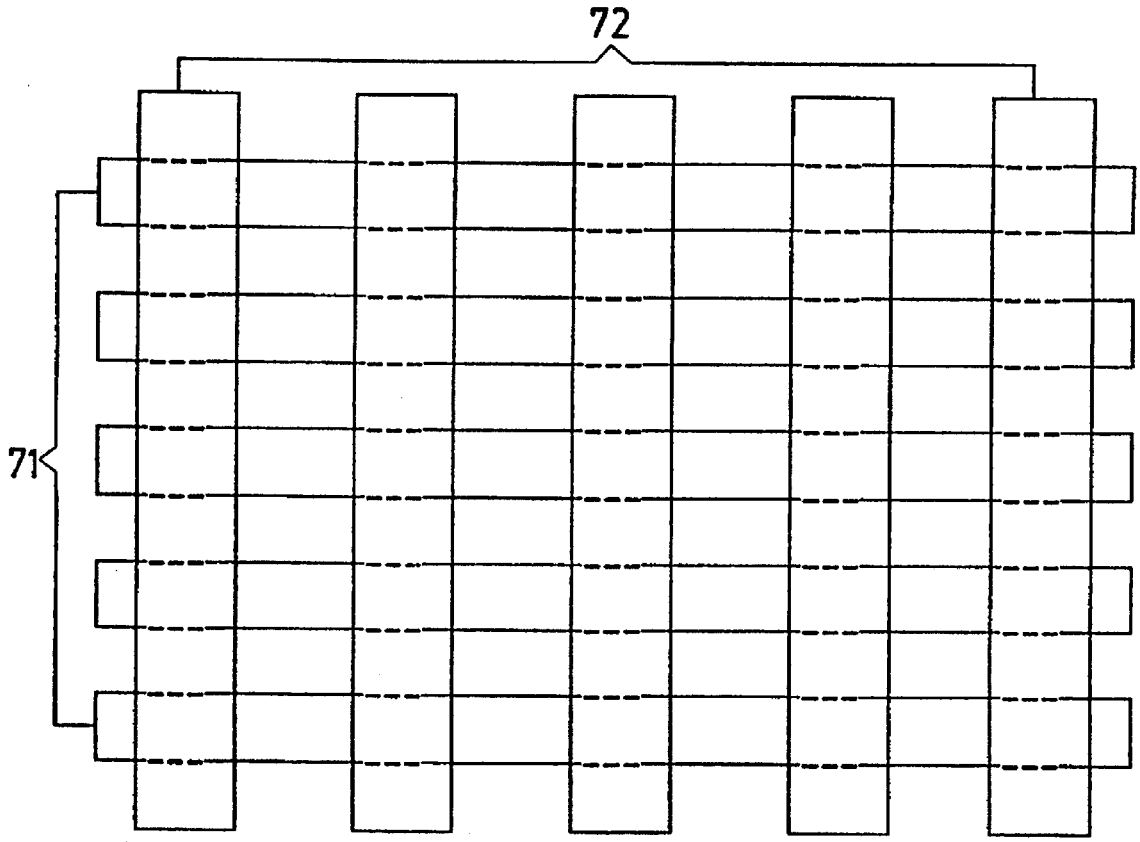
FIG. 11 shows a matrix electrode.

The display panel is schematically shown in FIG. 11, and is formed of perpendicularly disposed groups of scanning electrodes 71 and signal electrodes 72. A ferroelectric liquid crystal compound is interposed between the two groups of electrodes.

Figure 2:
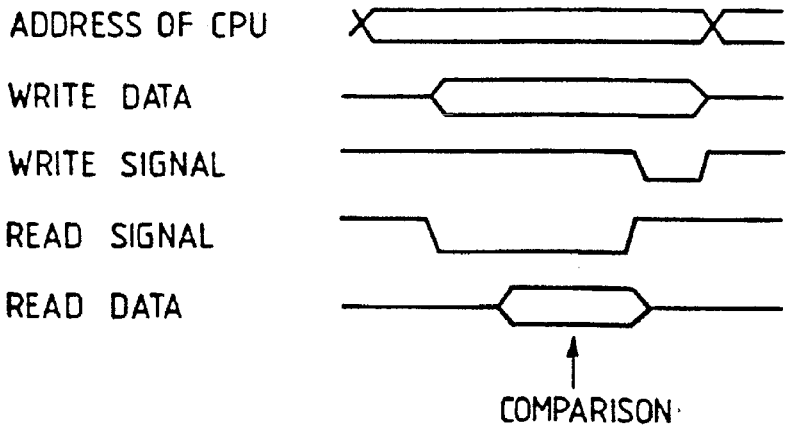
FIG. 2 is a timing chart showing read modify write of a display information storage memory.

With reference again to FIG. 1, the drawer 11 performs write access of the VRAM 12, the read modify write function of the memory is used to read out data and then compare whether or not the readout data is identical with the write data. If the readout data is identical with the write data, the drawer 11 then writes the data at a designated address of the VRAM 12. However, when these data are not identical, the flag 14 corresponding to this address is set. Although a normal dynamic RAM can simultaneously perform write access and read access, a dual port RAM frequently used as a display memory requires a longer processing time, as shown in a timing chart of FIG. 2.

In the FLC panel 16, even after one-bit data on one line is updated, one-line data must be sent to the FLC panel 16. Therefore, each flag 14 can be a one-bit flag for a one-line address of the memory.

The sequencer 15 normally performs interlaced display refreshing and checks the flags 14. If all the flags 14 corresponding to the respective lines are not set, refreshing must be repeated. However, if some flags 14 are set, the addresses of the VRAM 12 are calculated by the number of these set flags. The sequencer 15 sends corresponding one-line data to the FLC panel 16, and the set flags 14 are cleared.

Figure 3:
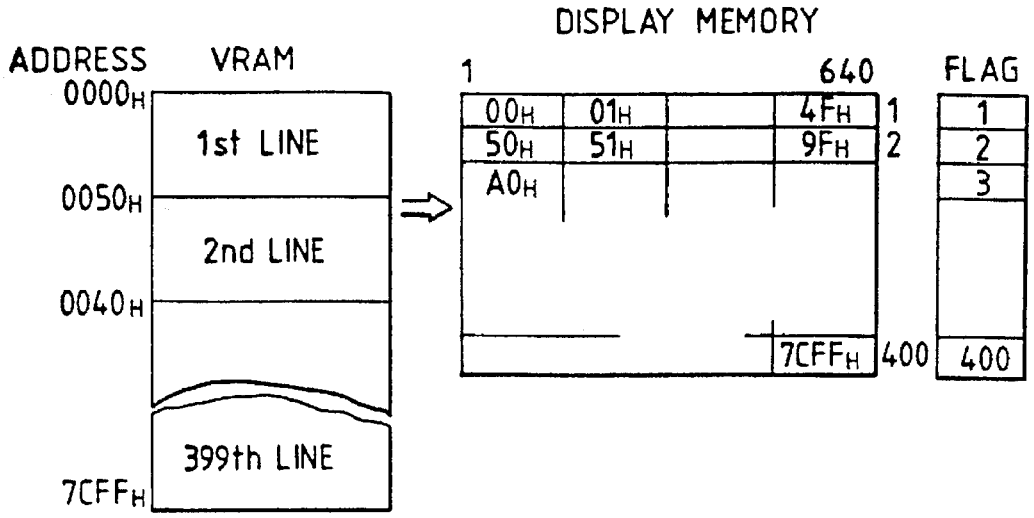
FIG. 3 is a view showing a relationship between a memory map of a VRAM and flags.

FIG. 3 shows a relationship between the VRAM 12 and the flags 14 when the FLC panel 16 of 640×400 dots is used. Note that an address and data are represented as xxH (hexadecimal notation). For example, 01H is "01" in hexadecimal notation, and 4FH is "4F" in hexadecimal notation.

When the drawer 11 writes data at addresses 00H to 4FH, this range corresponds to display data of the first line. The first one of the flags 14 is set. Furthermore, when the first flag is already set, data of 00H to 4FH is transferred to the FLC panel 16 as the first-line data. In a normal operation, when all the flags 14 are not refreshed, the sequencer 15 performs interlaced display refreshing. If some flags 14 are set upon checking of all the flags, addresses of the VRAM 12 are calculated as described above, and the corresponding data are transferred to the FLC panel 16. The set flags 14 corresponding to the display lines are reset.

In the FLC panel 16 of 640×400 dots of this embodiment, partial updating can be detected by a 400-bit memory serving as the flags 14. Although detection precision is degraded, a one-bit flag for two or four lines may be used to send four-line data to the FLC panel 16 if only of the dots of the four lines is updated. In this case, the memory capacity for the flags 14 can be further decreased. For example, when 20 lines are used as one row and the above-mentioned panel of 640×400 dots is used as a display for displaying 20 rows, updating can be performed in units of rows. In this case, a 20-bit memory can be added to constitute the flags 14 so as to detect partial updating.

Figure 4:
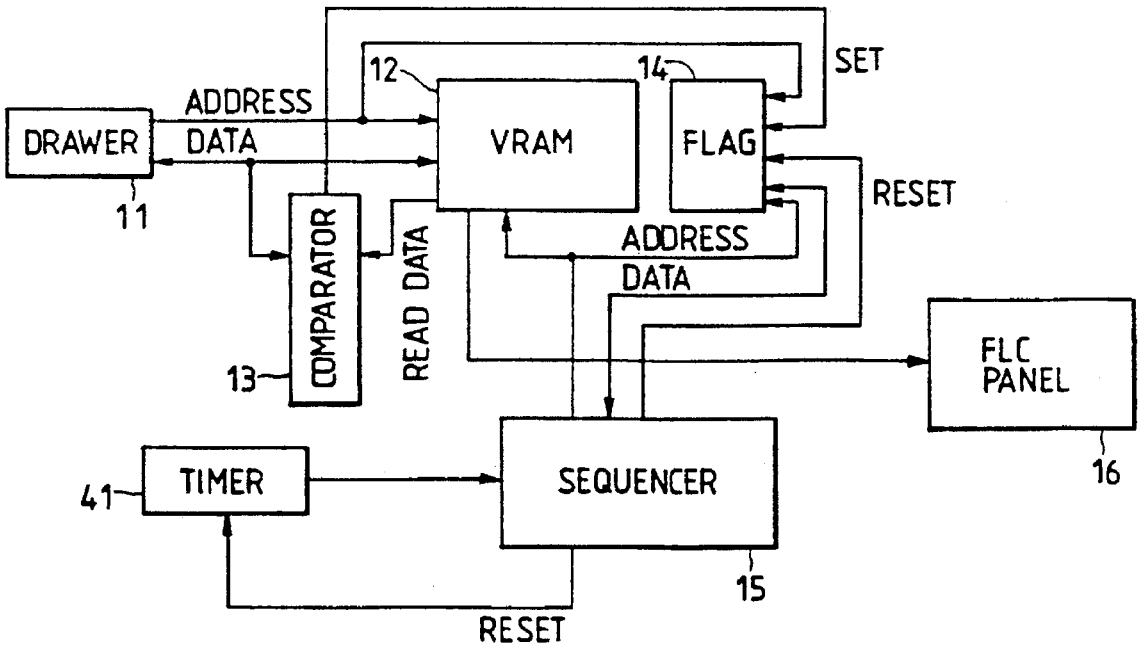
FIG. 4 is a block diagram of a display system according to another embodiment of the present invention.

FIG. 4 shows a display system according to another embodiment using a timer 41 for determining a minimum refresh scanning frequency.

Figure 5:
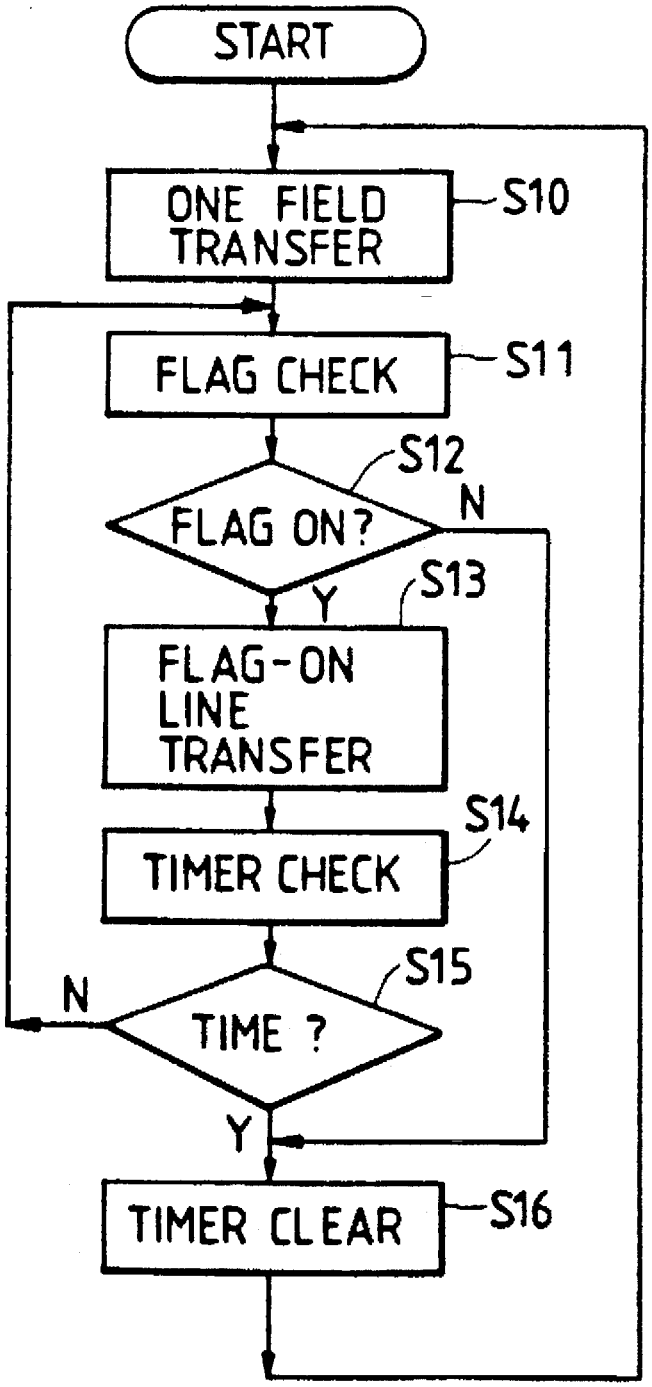
FIG. 5 is a flow chart for explaining the operation of the display system shown in FIG. 4.

FIG. 5 is a flow chart for explaining the operation of the display system shown in FIG. 4.

The operation of the display system shown in FIG. 4 will be described with reference to the flow chart of FIG. 5.

In a normal operation, when all the flags 14 are reset, the sequencer 15 generates addresses for interlaced display refreshing. In step S10, the sequencer 15 transfers display data (one-field data) of the VRAM 12 to the FLC panel 16. The flags 14 corresponding to the transferred display line data are cleared. In step S11, after one-field data is transferred, the sequencer 15 checks all the flags 14. In step S12, when all the flags 14 are reset, the sequencer 15 resets the timer 41, and the flow returns to step S10. As described above, refreshing of the FLC panel 16 is repeated.

When the drawer 11 performs cursor or mouse write access of the VRAM 12, the flag 14 of the display line corresponding to this address is set. In step S11, the sequencer 15 checks all the flags 14. If the sequencer 15 determines in step S12 that the flag 14 corresponding to a given display line is set, the display data of the given display line of the flag 14 is transferred to the FLC panel 16. The flag 14 corresponding to the given display line is cleared. In step S14, the sequencer 15 checks a count time of the timer 41. In step S15, when the count time of the timer 41 does not exceed a predetermined value, the flow returns to step S11, and the sequencer 15 checks the flags 14 again.

When the count time of the timer exceeds the predetermined value in step S15, the timer is cleared to zero in step S16, and the flow returns to step S10 again.

If the drawer 11 performs write access of the VRAM 12 and an appropriate number of ON flags 14 is detected, the flow advances from step S11 to step S15 and returns to step S11, thereby sequentially transferring the updated display data to the FLC panel 16. However, during this period, the timer 41 continues the time count operation. The sequencer 15 determines in step S15 whether a predetermined period of time has elapsed. If YES in step S15, the sequencer 15 interrupts partial updating/scanning and resets the timer 41. Refreshing of the sequencer 15 is then restored. When the sequencer 15 checks the flags 14 upon refreshing of one field, the remaining flags 14 are kept set, and the remaining write operations continue.

Upon completion of the above operations, flickering can be prevented without decreasing the frame (field) frequency below 1/(predetermined period of time+one vertical scanning interval).

Figure 6:
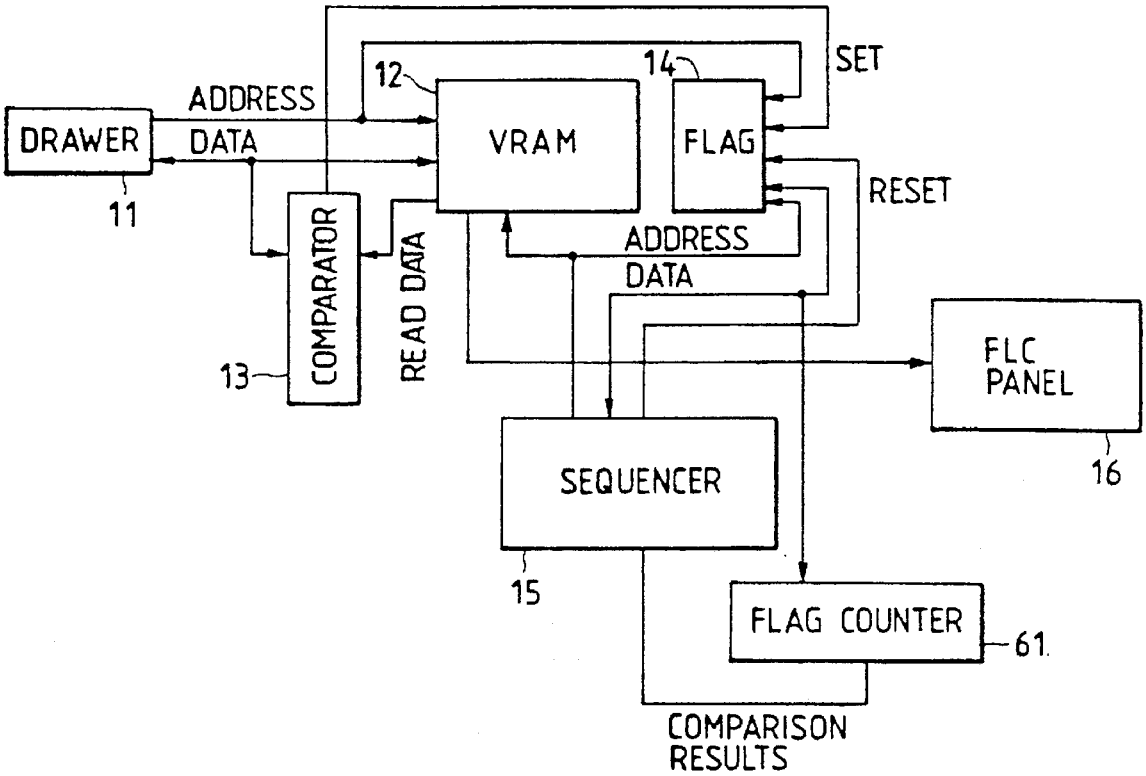
FIG. 6 is a block diagram of a display system according to still another embodiment of the present invention.

FIG. 6 shows a display system using a flag counter 61 for counting ON flags of flags 14 according to still another embodiment of the present invention.

Figure 7:
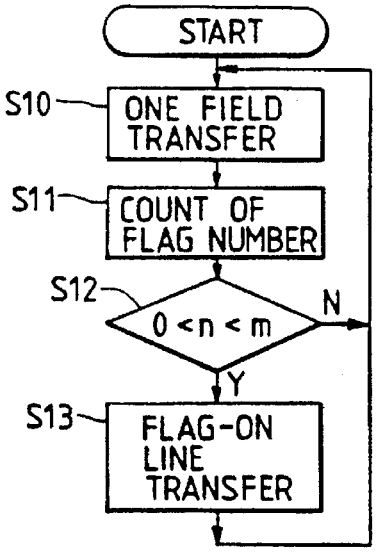
FIG. 7 is a flow chart for explaining the operation of the display system shown in FIG. 6.

The operation of the system shown in FIG. 6 will be described with reference to a flow chart in FIG. 7.

In a normal operation, when all the flags 14 are reset, a sequencer 15 generates addresses for interlaced display refreshing and transfers display data (one-field data) from a VRAM 12 to an FLC panel 16. The flag 14 corresponding to the transferred display line data is cleared. After one-field data is transferred, the sequencer 15 counts the number of ON flags of the flags 14 in step S11. In step S12, the sequencer 15 uses the flag counter 61 to count the number of ON flags 14. When write access of the VRAM 12 is completed by the drawer 11, the flags 14 of the display lines corresponding to the addresses are set.

If the number n of ON flags 14 is 0 or a predetermined value m or more, e.g., ¼ or more of all the display lines, in step S12, the flow returns from step S12 to step S10, and refreshing of the FLC panel 16 is repeated.

The sequencer 15 counts the number n of ON flags 14 in step S11. In step S12, the count of the flag counter 61 is checked by the sequencer 15. If the number of ON flags falls within the range of $0<n<m$, the display data of display lines corresponding to the ON flags are transferred to the FLC panel 16 in step S13. The flow returns to step S10, and refreshing is repeated.

Figure 8:
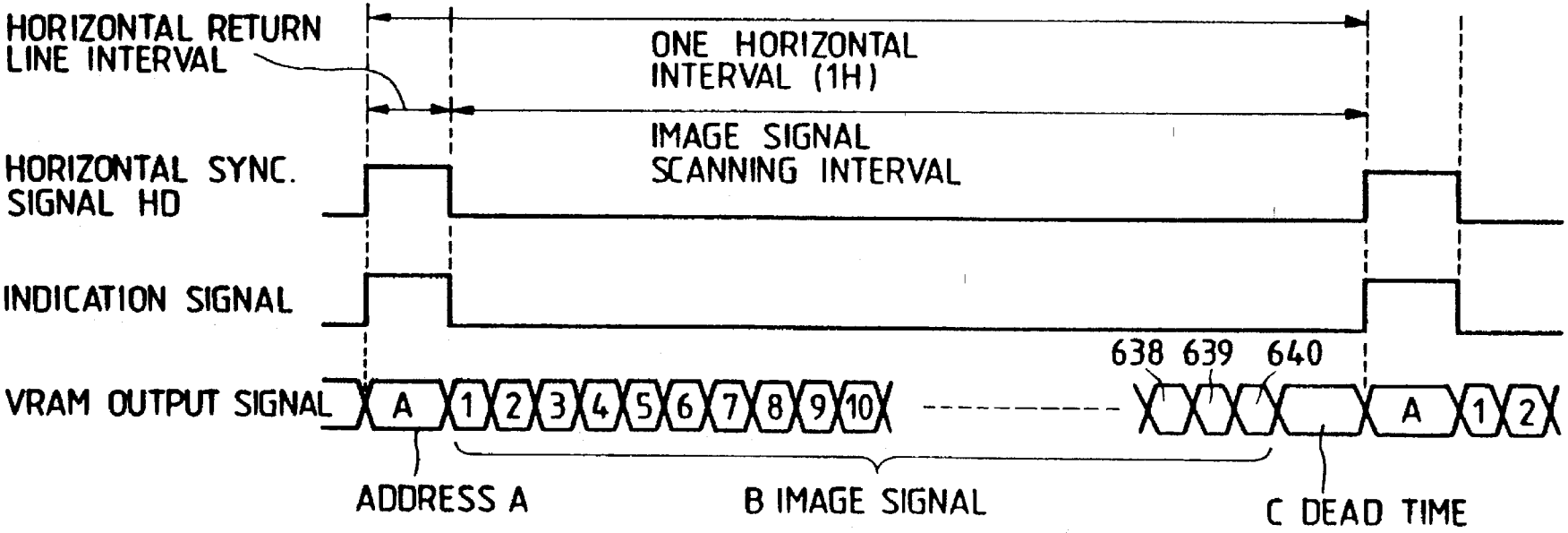
FIG. 8 is a timing chart of VRAM output signals.

FIG. 8 is a timing chart of scanning line address information A and an image signal B output from the VRAM 12 to the FCL panel 16. A one-horizontal scanning interval corresponds to one scan selection interval. When the horizontal sync signal HD is set at a high level, the scanning line address information A is detected. However, when the horizontal sync signal HD is set at a low level, the image signal B is detected. The horizontal sync signal HD is synchronous with an indication signal.

A scheme for applying a scan selection signal to scanning lines corresponding to only a partial updating area can be applied to a partial updating scheme used in the present invention, as disclosed in U.S. Pat. Nos. 4,655,561 and 4,693,563. This partial updating scheme is not limited to a character correction display within the display screen, but can also be utilized for a multiwindow display, an intrawindow scroll display, and a cursor or mouse shift display designated from a pointing device.

Figure 9:
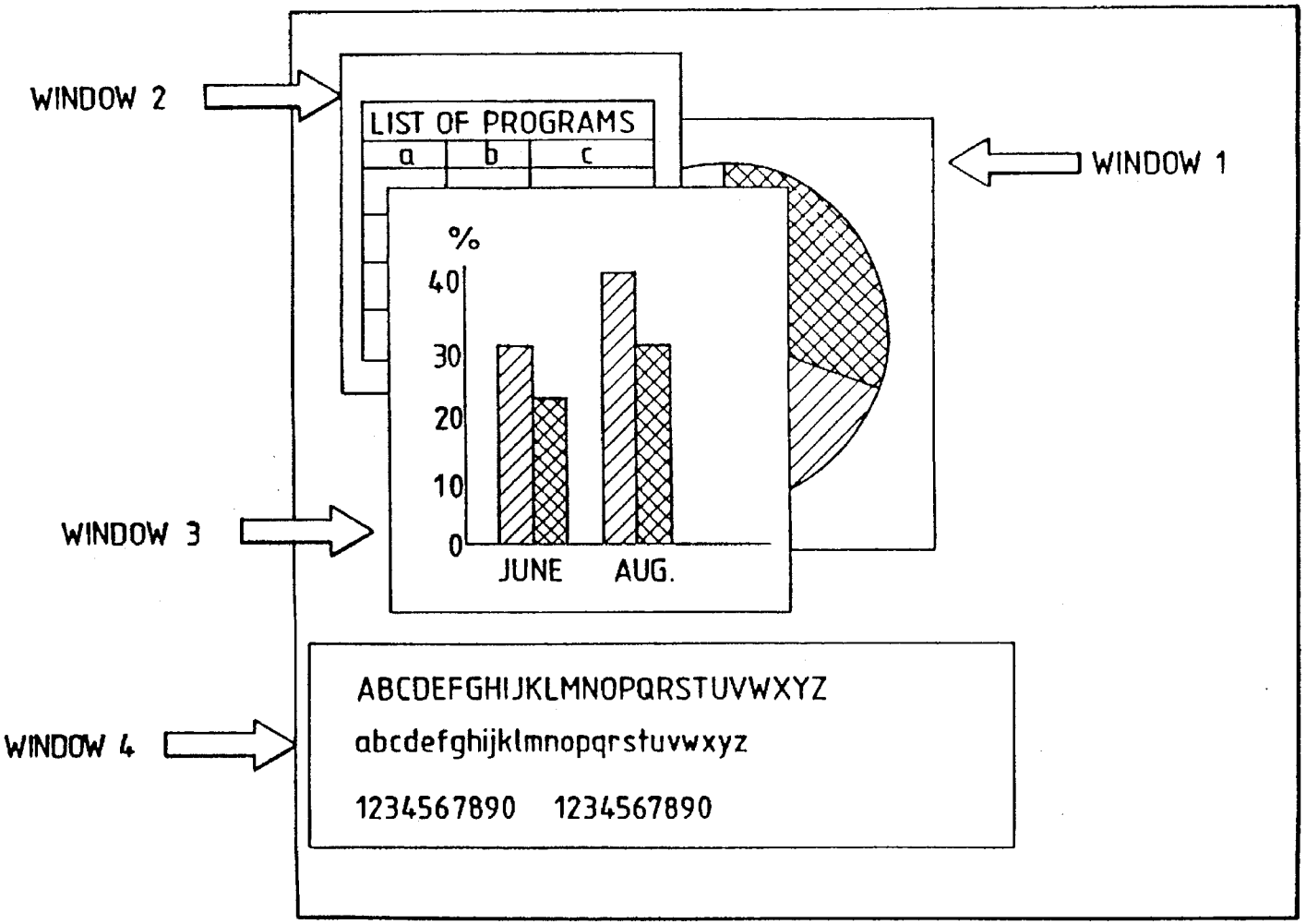
FIG. 9 is a view showing a display screen of an image display using the system of the present invention.

FIG. 9 shows a multiwindow screen display. The multiwindow display screen consists of different layers in different display areas. Window 1 represents a layer for expressing a summation result in a circle graph. Window 2 represents a layer for expressing the summation result of window 1 in a table. Window 3 represents a layer expressing the summation result of window 1 in a bar graph. Window 4 represents a layer associated with documentation. The background is white.

Assume that window 4 is a work layer and other windows are kept in a still image state. That is, window 4 is kept in a dynamic display state during documentation. Detailed operations in the dynamic state are scrolling, insertion, deletion, and copying of words and clauses, and a block shift. These operations require relatively high-speed processing. Display operations will be exemplified below.

First Operation

One character is added to any line within window 4. A character font has a 16×16 dot format. In order to add and display one character, 16 scanning lines are updated. Therefore, these 16 scanning lines are scanned and driven.

Second Operation

Assume that window 4 is set in a smooth scroll state.

The number of scanning lines constituting window 4 is 400. A smooth scroll display is performed by scanning and driving only these 400 scanning lines, thereby updating these lines.

According to refreshing/scanning scheme used in the present invention, a scan selection signal is cyclically applied. In this case, a one-screen content must be obtained by one-frame scanning (or one-field scanning) In other words, it is necessary to complete selective write access of a one-scanning line black pixel display based on a dark state of the FLC and a one-scanning line white pixel display based on a bright state of the FLC during each scanning of one scanning line.

In particular, the refreshing/scanning scheme used in the present invention is preferably a "multi-interlaced scanning scheme" for selectively applying a scan selection singal every two or more scanning lines, and more preferably every four or more scanning lines (the selection signal is preferably applied every four to 20 scanning lines).

Figure 10A:
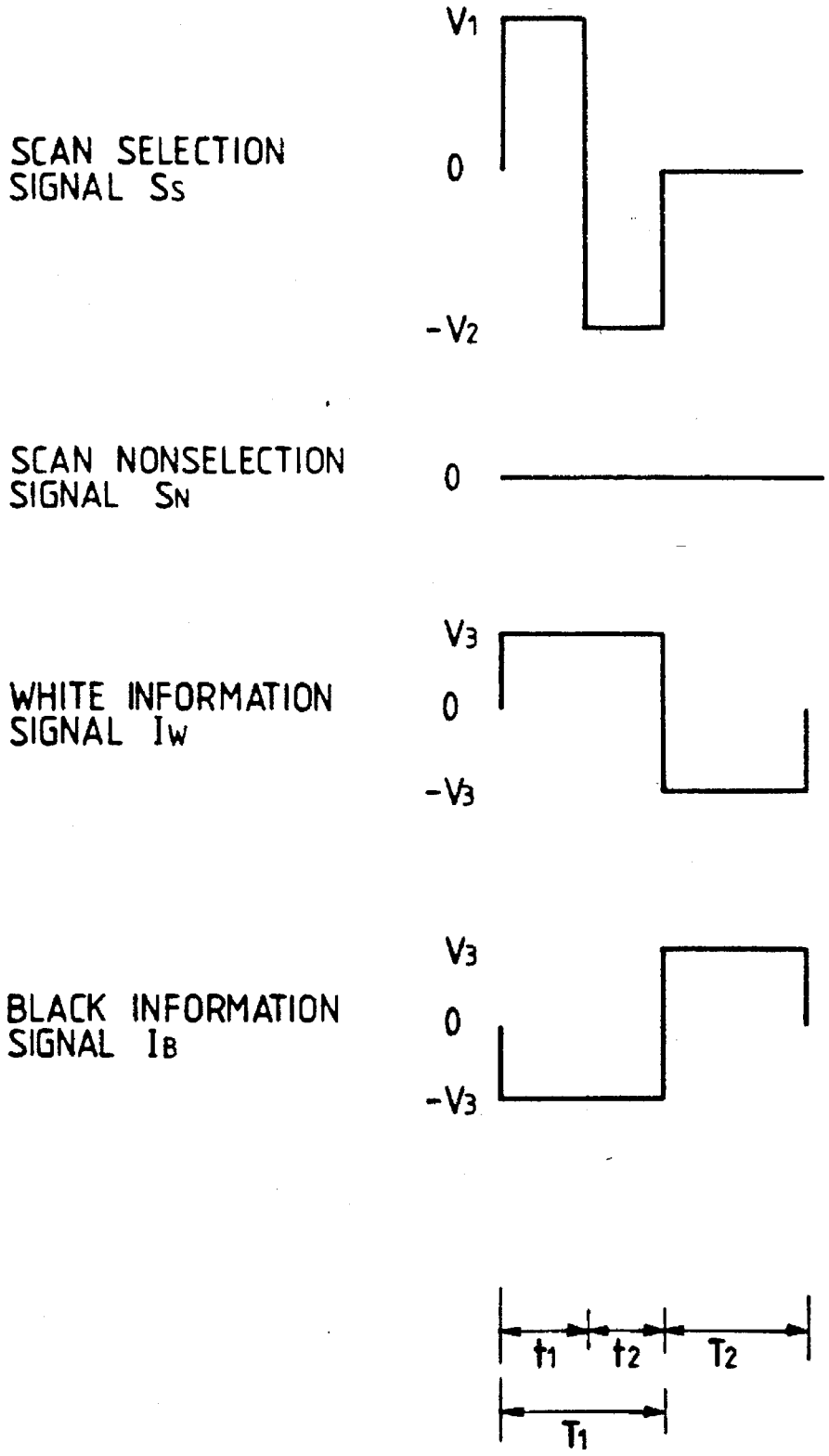
FIGS. 10A to 10C are waveform charts of drive voltages used in the system of the present invention.
Figure 10B:
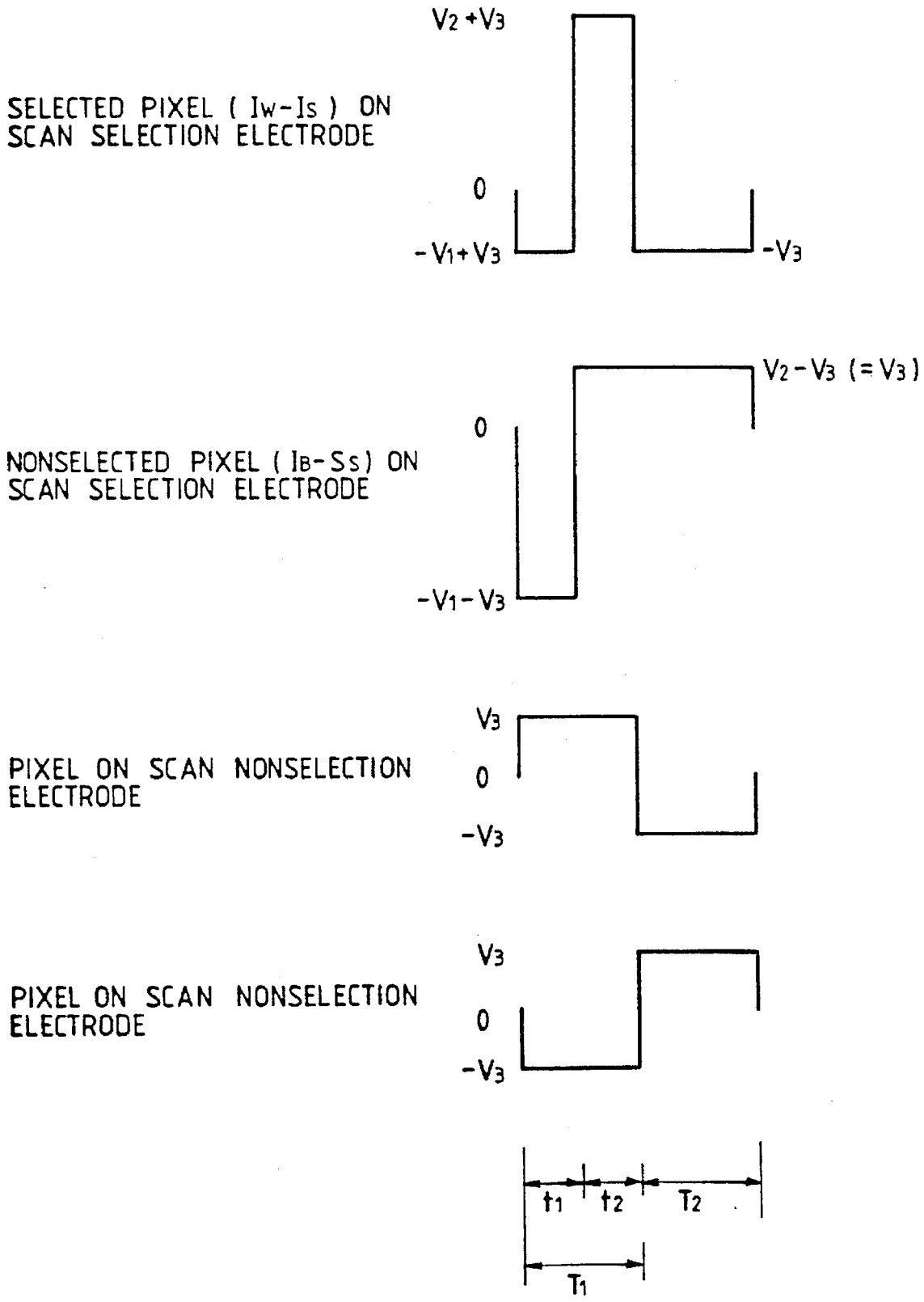

FIG. 10A shows a scan selection signal $S_S$, a scan nonselection signal $S_N$, a white information signal $I_W$, and a black information signal $I_B$. FIG. 10B shows a waveform of a voltage applied to a selected pixel (this pixel is applied with the white information signal $I_W$ and a voltage $(I_W-S_S)$) of pixels (intersections between the scanning electrodes and the information electrodes) on the scan selection electrodes applied with the scan selection signal $S_S$, a waveform of a voltage applied to a nonselected pixel (this pixel is applied with the black information signal $I_B$ and a voltage $(I_B-S_S)$) on the same scan selection electrode, and a waveform of a voltage applied to two types of pixels on scan nonselection electrodes applied with the scan nonselection signal.

Referring to FIGS. 10A and 10B, a voltage $(-(V_1+V_3)$ serving as a voltage exceeding one FLC threshold voltage is applied to the nonselected pixel on the scan selection electrode at a phase $t_1$. One aligning state of the FLC is caused to obtain a dark state, thereby completing black write access. In this case, at the phase $t_1$, a voltage $(-V_1+V_3)$ serving as a voltage lower than the above FLC threshold value is applied to the selected pixel on the scan selection electrode, thereby inhibiting a change in aligning state. At a phase $t_2$, a voltage $(V_2+V_3)$ serving as a voltage exceeding the other FLC threshold value is applied to the selected pixel on the scan selection electrode, so that the FLC is changed to the other aligning state to obtain a bright state, thereby writing a white pixel. At the phase $t_2$, a voltage $(V_2-V_3)$ serving as a voltage below the other FLC threshold value is applied to the nonselected pixel on the scan selection electrode. In this case, the previous aligning state at the phase $t_1$ is not changed. Voltages $\pm V_3$ below the FLC threshold values are applied to the pixels on the scan nonselection electrodes at the phases $t_1$ and $t_2$. For this reason, in this embodiment, white or black data is written in the pixel on the scan electrode selected at a phase $T_1$. Even if a scan nonselection signal is then applied to this pixel, the write state is maintained. A voltage having a polarity opposite to the information signal obtained at the write phase $T_1$ is applied from the information electrode at a phase $T_2$. Therefore, as shown in FIG. 10C, an AC voltage is applied to the pixel during scan nonselection, thereby improving the FLC threshold characteristics.

Figure 10C:
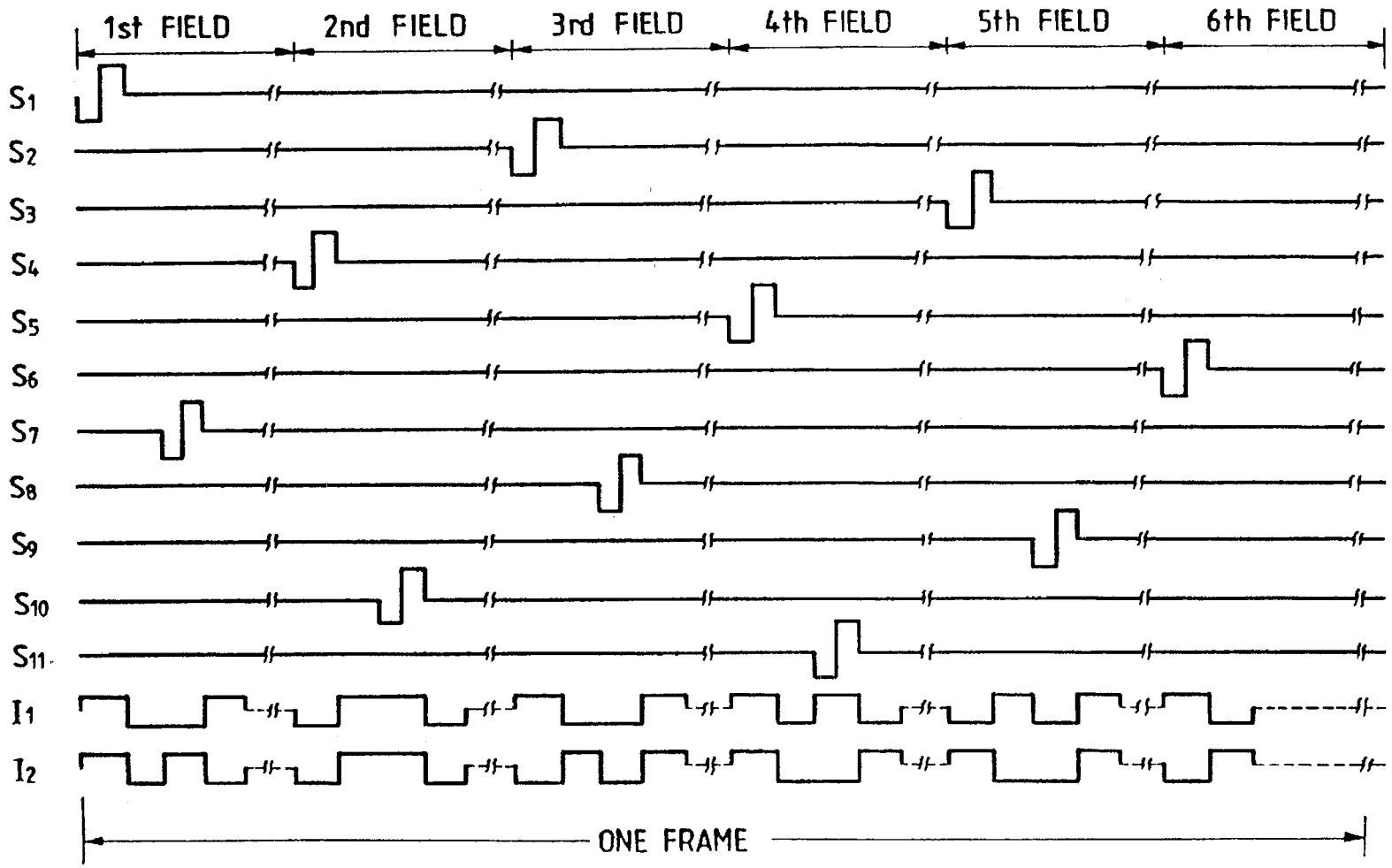

FIG. 10C is a timing chart of voltage waveforms for obtaining a certain display state. In this embodiment, the scan selection signal is applied every five scanning electrodes so that the scan selection signals are applied to scanning electrodes which are not adjacent to each other. The scanning electrodes are selected every five electrodes, and one-frame scanning is completed by six field scanning cycles. A scan selection period $(T_1+T_2)$ is set to be long at a low temperature, and flickering can be greatly suppressed even in scanning at a low frame frequency (e.g., a frame frequency of 5 to 10 Hz). In addition, scan selection signals are applied to scanning electrodes which are not adjacent to each other during scanning of six fields, and picture torn can be effectively prevented.

An FLC element used in the present invention can be selected from ones disclosed in U.S. Pat. Nos. 4,367,924, 4,639,089, 4,655,561, 4,697,887, and 4,712,873. In a preferable example of such an FLC element, a cell thickness (i.e., a distance between upper and lower substrates) is set to be small enough to suppress occurrence of a spiral aligning state inherent to a chiral smectic layer in a bulk state, thereby obtaining a bistable aligning state.

According to the present invention as has been described above, write access of the display memory by the drawer is simultaneously performed with its read access, and therefore, the processing time can be shortened. Since a flag representing a comparison result may have one bit for one display line, the flags can be constituted by a memory having the number of bits corresponding to the number of display lines. Therefore, partial write access can be detected by adding a memory having a capacity of a fraction of several millions of the total capacity as compared with a method using two display memories. The present invention can be achieved by only easy hardware from which the capacity of the display memory can be reduced, thereby advantageously using a large volume of software.

According to the present invention, flags representing that partial write access was completed are provided in correspondence with the display lines of the FLC display. Partial write access can be detected by adding a memory having a capacity of a fraction of several millions of the total capacity as compared with a method using two display memories. The present invention can be achieved with easy hardware from which the capacity of the display memory can be reduced, thereby advantageously using a large volume of software. In addition, the flags corresponding to the display lines which have been updated in correspondence with any display lines in the display memory during partial updating are set, and only the partially updated display data can be transferred with reference to the set flags. Therefore, even during scanning at a low frame frequency, a cursor position designated by a pointing device can be shifted and displayed at high speed.

Furthermore, according to the present invention, multi-interlaced scanning refreshing of the FLC display is performed every predetermined period, thereby suppressing picture disturbance such as a decrease in contrast level at a position on the screen where no flickering occurs and partial write access is not performed. Moreover, a cursor display can be optimized.

What is claimed is:

1. A display system comprising:

a. a display panel having matrix electrodes comprised of scanning lines and information lines;

b. a display information storage memory for performing write access of transmitted write data and for performing read-out access of stored read out data; and c. control means for comparing the write data with the read out data, for performing a first sequence of scanning a scanning line corresponding to a partial region in a display image frame at a changing display at the partial region and for performing a second sequence of interlace refresh scanning the scanning line in the display image frame at a non-changing display on the display image frame, wherein the first sequence is interrupted when a predetermined time of the first sequence elapses, and therefore the second sequence is performed.

2. A system according to claim 1, wherein said control means comprises a flag memory for storing address information for designating the scanning line corresponding to the write data different from the readout data.

3. A system according to claim 1, wherein said display panel has a memory effect.

4. A system according to claim 1, wherein said display panel comprises a ferroelectric liquid crystal.

5. A system according to claim 1, wherein said control means comprises a timer for counting the predetermined period of time required for performing the first sequence.

6. A display system according to claim 1, wherein the address information of the rewritten write data corresponds with cursor information.

7. A display system according to claim 1, wherein the refresh-scanning comprises interlaced scanning.

8. A display system according to claim 1, wherein the interlace scanning is a skip scanning skipping two or more scanning lines.

* * * * *

UNITED STATES PATENT AND TRADEMARK OFFICE

CERTIFICATE OF CORRECTION

PATENT NO. : 5,629,717

DATED : May 13, 1997

INVENTOR(S) : Netsu

It is certified that error appears in the above-indentified patent and that said Letters Patent is hereby corrected as shown below:

COLUMN 5:

Line 54, "$(-(V_1+V_3)$" should read -- $-(V_1+V_3)$--.

Signed and Sealed this

Seventeenth Day of February, 1998

Bruce Lehman

*Attest:*

BRUCE LEHMAN

*Attesting Officer*

*Commissioner of Patents and Trademarks*